US005966424A

United States Patent [19]

Liu

[11] Patent Number: 5,966,424

[45] Date of Patent: Oct. 12, 1999

[54] RADIATION-SHIELDING, INTERPOLATIVE-SAMPLING TECHNIQUE FOR HIGH SPATIAL RESOLUTION DIGITAL RADIOGRAPHY

[75] Inventor: Hong Liu, Charlottesville, Va.

[73] Assignee: The University of Virginia Patent Foundation, Charlottesville, Va.

[21] Appl. No.: 08/856,981

[22] Filed: May 15, 1997

Related U.S. Application Data

[60] Provisional application No. 60/017,780, May 15, 1996.

[51] Int. Cl.[6] ..... H05G 1/64

[52] U.S. Cl. ..... 378/98.8; 378/98.12

[58] Field of Search ..... 378/98.8, 98.12

[56] References Cited

U.S. PATENT DOCUMENTS 5,648,997 7/1997 Chao ..... 378/98.12

*Primary Examiner*—Craig E. Church

*Attorney, Agent, or Firm*—Oblon, Spivak, McClelland, Maier & Neustadt, P.C.

[57] ABSTRACT

A method of obtaining high resolution, spatial images from a flat-panel imager is provided, in which a radiation opaque filter is provided over the flat-panel imager, interposed between the x-ray source and the patient tissue. The filter, comprised of x-ray and similar high energy radiation opaque material, is provided with an array of apertures in exact alignment with each pixel of the flat-panel imager. Each aperture has a diameter of about one-half a pixel. An initial image is taken, and then the filter and imager are moved, synchronously, to obtain three additional images, each motion repositioning the filter and imager, synchronously, a distance of one-half of one pixel. This results in four discontiguous x-ray exposures, which can be interpolated, preferably by computer algorithm, into a continuous, high resolution image. Although four exposures are needed, because of the presence of the filter, the patient dose remains the same as if only one exposure is made.

4 Claims, 1 Drawing Sheet

RADIATION-SHIELDING, INTERPOLATIVE-SAMPLING TECHNIQUE FOR HIGH SPATIAL RESOLUTION DIGITAL RADIOGRAPHY

This application is a regular National application claiming priority from Provisional Application, U.S. application Ser. No. 60/017,780 filed May 15, 1996.

BACKGROUND OF THE INVENTION

1. Field of the Invention

This invention pertains to an electronic imaging technique using a novel radiation-shielding, interpolative-sampling mechanism. It provides a new imaging modality for digital radiography. Using this technique, a low spatial resolution flat-panel imager (such as Amorphous Silicon, Selenium, etc.) can be used effectively for high spatial resolution digital radiography.

2. Background of the Prior Art

The recent development of Amorphous Silicon and selenium technology make the flat-panel, solid-state imagers very promising in some diagnostic x-ray projection imaging. However, the current technology in electronics and material science limits the potential to reduce the pixel size (presently 100 to 200 microns) of these large area, two-dimensional arrays. Many current procedures (such as mammography) require high spatial resolution which requires an image with a pixel size that is smaller than 100 microns.

A variety of companies have invested millions of dollars to develop the high spatial resolution, flat-panel imagers for large field digital mammography and digital radiography. For instance, General Electric has developed a flat panel imager that can cover a full-field of a breast for digital mammography. The physical pixel size of the imager, however, is about 100 microns (Niklason L T, Christian B T, Whitman G J, Kopans D B, Rougeot H M, Opsahl-one B, "Full-field digital mammographic imaging, Radiology" (abstract), 201 ():446, 1996). This invention provides a unique, inexpensive solution to the technical challenge of covering a large field while maintaining high spatial resolution, within the constraints of the current technology. None of them has been successful up to now. This invention provides a unique, inexpensive solution to this difficult problem within the constraints of the current technology.

SUMMARY OF THE INVENTION

A filter or multiaperture collimator, of lead or other x-ray opaque material, has a mosaic of apertures (holes) in exact alignment with each pixel of the imager, and is moved synchronously with the imager. The size (diameter) of each aperture of said filter or multiaperture collimator is about one-half of the pixel size. The filter or multiaperture collimator is interposed between the x-ray source and the patient, with the imager on the opposite side of the patient.

To acquire a full image, the combination filter or multiaperture collimator and imager are synchronously repositioned three times in four positions, to produce a total of four x-ray exposures, including the original exposure. The distance of each repositioning is one-half pixel, the diameter of the apertures of the filter or multiaperture collimator. From the four images obtained, a continuous, high resolution image is obtained within the limits of currently available imagers.

DETAILED DESCRIPTION OF THE FIGURE

Figure 1:
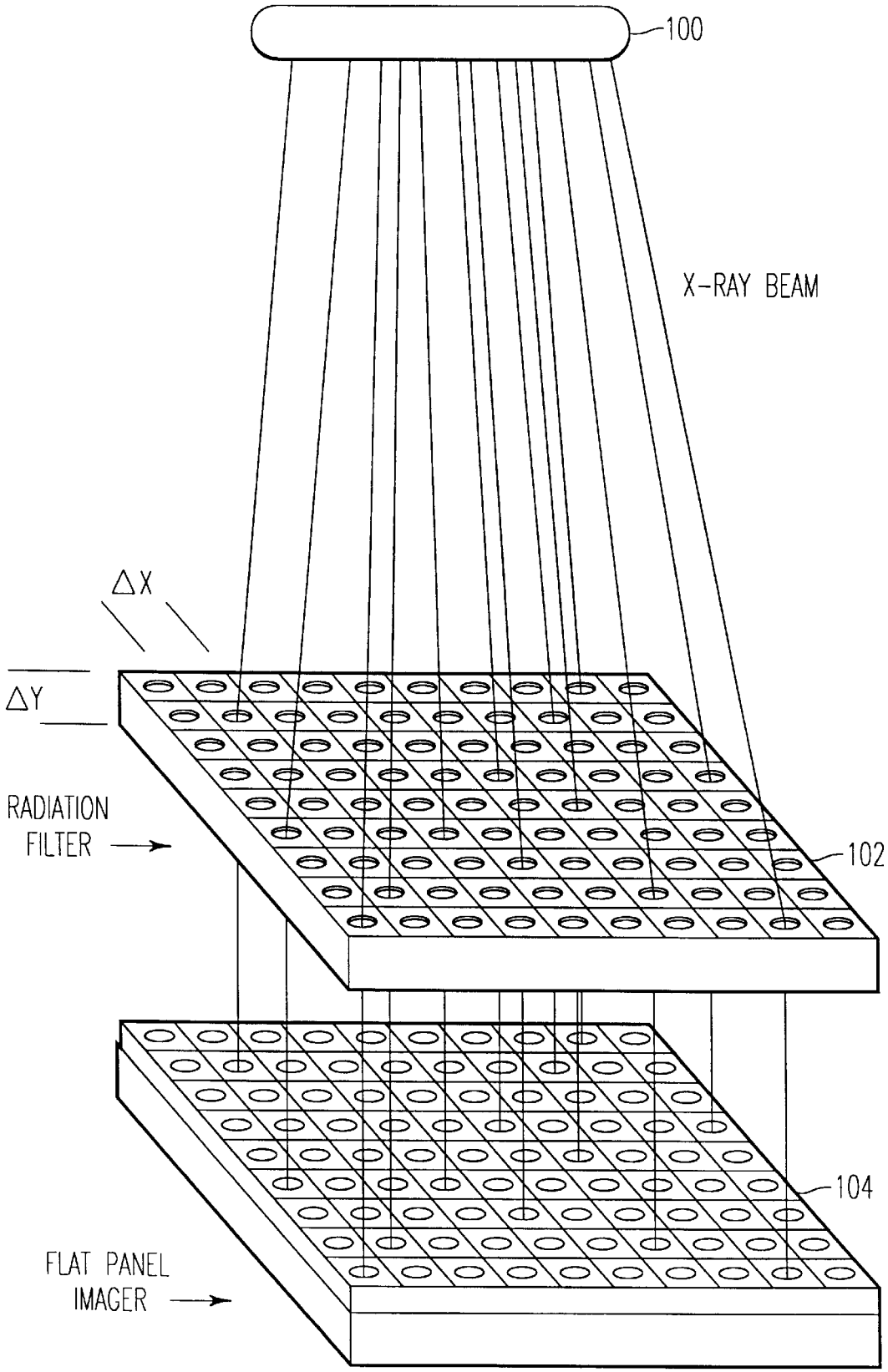

FIG. 1 is a schematic illustration of the relationship between the radiation filter or multiaperture collimator, flat panel imager and x-ray beam of the claimed invention. The x-rays are emitted from source 100, pass through the filter or multiaperture collimator 102 apparatus, impinge on a patient (patient not illustrated) and impact the flat panel imager 104.

DETAILED DESCRIPTION OF THE INVENTION

By obtaining four related images, each "stepped" one-half pixel from the prior image, a database of four digital images is obtained. These images are employed to build up a high resolution continuous image.

In the practice of the invention, any conventional electronic imager can be employed. These imagers include, but is not limited to, CCD imagers, active pixel arrays, Amorphous Silicon arrays, Amorphous Selenium arrays, thin film transistor arrays, etc. The radiation filter or multiaperture collimator is prepared from any conventional x-ray opaque material, such as lead and the like. The radiation filter or multiaperture collimator is interposed between the x-ray or high energy radiation source and the patient, or patient tissue, to be studied. The imager is provided on the other side of the patient, aligned with the filter or multiaperture collimator. An initial image is obtained, by irradiating the filter and imager through the patient. The filter or multiaperture collimator/imager is translated one-half pixel, in the direction of either Y or X as illustrated in FIG. 1. It is important the filter or multiaperture collimator 102 and and imager 104 translate synchronously, and maintain the same spacing, one to the other. A second exposure is made. The filter/imager combination is then repositioned in the direction, X or Y, that it was not moved to obtain the second exposure, and a third exposure is obtained. Again, the distance of repositioning is one-half of one pixel. Finally, a fourth image, moving the filter or multiaperture collimator and imager in a direction exactly opposite to that employed to obtain the second image, is completed.

Four discontinuous images have been obtained.

Importantly, the apertures of the filter or multiaperture collimator (one-half of one pixel in diameter) are precisely aligned with the pixels of the imager, one aperture per pixel. On repositioning, the filter or multiaperture collimator and imager translated synchronously a distance of one-half pixel diameter, and remain aligned for each image.

During the image acquisition, as described, the filter or multiaperture collimator and the imager will be repositioned three times, and a total of four x-ray exposures is made. The distance of each repositioning is also one-half of one pixel. Clearly, each exposure samples the object (patient) in a discontinuous format and generates a digital array. A computer algorithm will then interpolate all four discontinuous arrays together to create a complete, continuous and high resolution image.

Thus, in one common algorithum, the first exposure provides digital image $$A_{ij};\ I=1,2,3,\ldots;j=1,2,3,\ldots$$

the second exposure gives an image $$B_{ij};\ I=1,2,3.\ldots;j=1,2,3\ldots$$

the third exposure gives a third image $$C_{ij}I=1,2,3,.\ldots;j=1,2,3\ldots$$

the fourth exposure gives a fourth image $D_{ij}$; $I$=1,2,3, . . . ;$j$=1,2,3 . . .

These images are combined with the following matrix order:

$A_{ij}$; $B_{ij}$ $C_{ij}$; $D_{ij}$; $I$ = 1, 2, 3, …; $j$ = 1, 2, 3, …

This and other algorithms, provided in commercially available software, can be run on conventional computing systems.

This imaging module is unique from most existing techniques because of its novel interpolative-sampling method. Using this technique, one can double the spatial resolution of the current available imagers. Although four x-ray exposures are required, the patient dose remains the same as if only one exposure is made, because of the utilization of the x-ray opaque filter.

Based on our investigation, a dose efficient, high spatial resolution x-ray imaging system may be achieved using the invented radiation-shielding, interpolative-sampling technique. For instance, a current flat-panel imager is provided with 150 micron pixels, which is not suitable for mammography or other radiological procedures which require a spatial resolution higher than 3.3 lp/mm. Using the inventive technique, the same imager was employed to acquire a digital radiograph with a spatial resolution greater than 6 lp/mm. An immediate application of the invention is in (but not limited to) full-size digital mammography and other radiological imaging.

The invention of this application is been described both generically, and with respect to specific embodiments. Examples are not intended to be limiting, and alternatives will occur to those of ordinary skill in the art, without departing from the spirit of the invention. The invention is limited only by the recitation of the claims set forth below.

What is claimed is:

1. A digital radiography apparatus, comprising an x-ray source, a flat-panel imager with a plurality of pixels, and an x-ray opaque multiaperture collimator between said x-ray source and an object to be imaged, wherein said multiaperture collimator is provided with an array of apertures in exact alignment with each said pixel, each said aperture having a diameter of about one-half a pixel diameter.

2. A method for obtaining a continuous, high resolution digital x-ray image, comprising:

exposing soft tissue of a patient to a source of x-rays, obtaining an image of x-rays transmitted through said patient tissue on a flat-panel imager, wherein said rays pass through a radiation multiaperture collimator interposed between said patient and said source, said imager having pixels and said radiation multiaperture collimator having apertures provided in exact alignment with each pixel of said imager, having a diameter about one-half of a pixel, moving said imager and multiaperture collimator synchronously a distance of one-half of one pixel, obtaining a second exposure, repositioning said multiaperture collimator and imager again by moving them synchronously one-half of one pixel and obtaining a third exposure, and synchronously repositioning said multiaperture collimator and imager a third time by one-half of one pixel, to obtain a fourth image, and interpolating said four images together to create a complete, continuous high resolution image.

3. The method of claim 2, wherein said tissue is breast tissue.

4. A digital radiography apparatus, comprising an x-ray source, a flat-panel imager with a plurality of pixel cells, and a x-ray opaque multiaperture collimator between said x-ray source and an object to be imaged, wherein said multiaperture collimator is provided with an array of apertures in exact alignment with each said pixel, each said aperture having a diameter of about one-half a pixel diameter, said apparatus further comprising translation apparatus for moving said multiaperture collimator and said flat-panel imager a distance of one-half of one pixel in each of three sequential translations, and data processing means for combining images obtained from said imager initially, and on each successive translation.

* * * * *